US006484761B2

(12) United States Patent
Puccio

(10) Patent No.: US 6,484,761 B2
(45) Date of Patent: Nov. 26, 2002

(54) VENTING DEVICE FOR HAZARDOUS MATERIAL CONTAINERS

(75) Inventor: Anthony Puccio, Highland, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/845,983

(22) Filed: Apr. 27, 2001

(65) Prior Publication Data

US 2002/0157727 A1 Oct. 31, 2002

(51) Int. Cl.[7] ..... B65B 1/04

(52) U.S. Cl. ..... 141/65; 141/98; 55/429; 55/432

(58) Field of Search ..... 141/67, 59, 65, 141/98, 383, 386; 55/428, 429, 432, 433, 521

(56) References Cited

U.S. PATENT DOCUMENTS 4,312,388 A * 1/1982 Hager et al. ..... 141/1
5,000,767 A * 3/1991 Sanders et al. ..... 55/302
5,262,578 A * 11/1993 Hall ..... 141/93
5,988,426 A 11/1999 Stern
5,992,475 A * 11/1999 Campbell ..... 141/329
6,021,917 A 2/2000 Lovell et al.
6,027,541 A 2/2000 Siemers
6,073,797 A 6/2000 Barous
6,085,664 A 7/2000 Early
6,158,607 A 12/2000 Wallberg

OTHER PUBLICATIONS

BOC Edwards Group PLC, Product Description for D–100 Chemical Dispense Unit, 1998.

* cited by examiner

*Primary Examiner*—Steven O. Douglas
(74) *Attorney, Agent, or Firm*—Ira D. Blecker

(57) ABSTRACT

A venting lid cover for a container that has a plate member that configurably attaches to the coaming of the drum container, and a plenum member that attaches to this plate member. The plate member has at least one plate opening (preferably two for standard 55-gallon drums) that are equal in number to bung holes in the container so that the bung holes can pass through the plate member. The plenum member has vapor inlet ports that are equal in number and positioned in close proximity to the plate openings.

20 Claims, 2 Drawing Sheets

VENTING DEVICE FOR HAZARDOUS MATERIAL CONTAINERS

BACKGROUND OF THE INVENTION

1. Field of the Invention

The present invention pertains to a lid cover for containers, and more particularly, to a venting lid cover adapted for use with drum containers (e.g., barrels) which may need vented assistance.

2. Description of the Related Art

Hazardous chemicals are often contained in drum containers and the vapors that emanate from the drum barrel openings (referred to as bung holes) must be controlled. One vapor control method includes placing the drum in an exhausted cabinet having an evacuating device. This generally requires that a large volume of ambient air be exhausted from the drum containers using a cabinet containing the drums. This is an inefficient operation due to the large sized air handling and removal equipment. Indeed, most of the vapors from a drum container are emitted only from the drum bungs when the drum is opened.

Another vapor control approach, that reduces the size of required equipment, is a separate lip exhauster device that is attached to the drum at each bung. This typically is an in-house solution and requires separate exhaust ducting to each bung hole that attaches with a fastener to the drum lid coaming (lip). This approach is cumbersome and inefficient since the fastener has to be affixed to the drum lip which in turn reduces operator access to the bung hole when making a connection.

Another approach includes a drum dome exhaust system that attaches to the top of a drum lid, which is transparent and has an exhausted dome that covers the entire drum. Such a system, referred to as a chemical dispense unit, is made by the BOC Edwards, Inc. of Wilmington, Mass., USA. Problems with this type of system include the need for drum connectors and associated duct piping that have to penetrate the dome. This in turn requires the operator to make the drum connections via hand-ports through the dome. Also, the dome requires a mechanism for lifting the dome up and out of the way to install and remove the drum container during transfers.

Of these approaches, the chemical drum exhaust cabinet is the most widely used system for vapor exhausting of drum containers. This system typically houses 55-gallon drum containers in the exhaust cabinet. Such a system is expensive at initial installation and expensive to operate (e.g., average use: 1000 cfm @ $3/cfm/yr equates to about $3K/yr). This system requires experienced operators who must be aware of and follow stringent safety requirements since many of the chemicals contained in the drums are either corrosive, hazardous or carcinogenic. For example, typical chemical agents used by a semiconductor manufacturer may include sulfuric acid, nitric acid, hydrochloric acid, hydrofluoric acid, ammonium hydroxide, plating solutions, etc.

Vent covers known in the container arts include U.S. Pat. No. 6,085,664, which discloses a vented hatch cover for a container having a hatch with a coaming surrounding the hatch opening. This cover is specifically designed for a railroad hopper car, which has a very different design compared to drum containers.

Thus, there is need for a drum container venting device that provides ease of use, yet inexpensively meets stringent safety requirements for personnel handling hazardous materials.

SUMMARY OF THE INVENTION

In accordance with the present invention, disadvantages and problems associated with previous venting devices and systems that handle hazardous materials in drum containers have been substantially reduced or eliminated. The present invention provides a venting lid cover that can be implemented with ease. The invention provides safety to personnel who handle hazardous materials in these containers.

To attain this objective, there is provided, according to one aspect of the invention, a venting lid cover that fits and "snaps" over the coaming (drum lip) of a drum container lid (e.g., a standard 55-gallon drum). The invention has particular use with drum containers holding hazardous chemical agents that must be properly vented when being transferred. The venting lid cover is constructed of a plate member with an attached plenum member that "snaps-on" the coaming of container lid. The plate has cutouts that allow the bung holes to pass through. Integral with the plenum member is an exhaust outlet port that attaches to the exhaust ducting. The plenum member attaches to the plate and has openings equal in number to bung holes of the container it operates with. The plenum member has vapor inlet ports that allow vapors from the bung holes to enter, that in turn exit through the exhaust outlet port. An external exhauster device attaches to the exhaust ducting, which can either be part of the ducting or a separate remote device of the facility. When the drum bung holes are open and the invention is installed on the lid of the container, any chemical vapors from the container are drawn into the exhaust ducting via the plenum member and removed from the facility safely and efficiently.

The invention provides many advantages over the conventional approaches as discussed above. Indeed, the venting lid cover is a separate reusable device that can be refitted and reused in a simple manner, with the invention self-alignment provided by the holes in the plate member that align with the bung holes on the top of a drum lid. The invention also allows different chemicals to be stored in standard sized drums without concern for contamination since the invention's venting lid cover never contacts the chemical agents in the container. Additionally, if required, the venting lid cover can be configured permanently to a stationary container since the design is rugged and reliable. The invention also allows operators the freedom of not having to wear respirators when making connections of the containers. In certain applications, the invention also eliminates the need for continuous exhausting of vapor from a stationary container stored in a facility when the bung holes are closed. The invention provides the added freedom on locating the transfer site for the container since complex ducting is not required. Finally, the invention obviates the need for complex exhaust cabinets for working with drum containers which in turn minimizes the size required for the exhauster device (e.g. fan or equivalent pumping device).

Thus, it is an object of this invention to provide a venting lid cover for a container that has a plate member that can configurably seal with the coaming of the container, and a plenum member that attaches to this plate member. The plate member has at least one plate opening that equals the number of bung holes in the container so that the bung holes can pass through the plate. The plenum member has vapor passage openings that are equal in number and configured next to these plate openings.

BRIEF DESCRIPTION OF THE DRAWINGS

The foregoing and other objects, aspects and advantages will be better understood from the following detailed description of a preferred embodiment(s) of the invention with reference to the drawings, in which.

DETAILED DESCRIPTION OF PREFERRED EMBODIMENTS OF THE INVENTION

The preferred embodiments of the present invention and its advantages are best understood by referring to FIGS. 1 through 4 of the drawings, like numerals being used for like and corresponding parts of the various drawings. The chemical industry uses various containers for chemical products. One of the most common types of drums is a thin wall steel drum that is typically manufactured in a fifty-five (55) gallon capacity. Such drums include a cylindrical side wall and a pair of circular ends. One of the ends, referred to as a lid, typically provides a pair of openings or bung holes, one of which is a larger opening for dispensing and filling the drum container, the other of which is a smaller opening for venting the container. The bung holes can be the same or a different size. The invention herein is preferably a separate venting lid cover 100 having an integral exhaust duct member attached to the plate member. The cover 100 captures chemical vapors that emanate from the open bung holes during drum hookup, chemical sampling, etc. The invention can be a stand-alone "snap-on" device.

Figure 1:
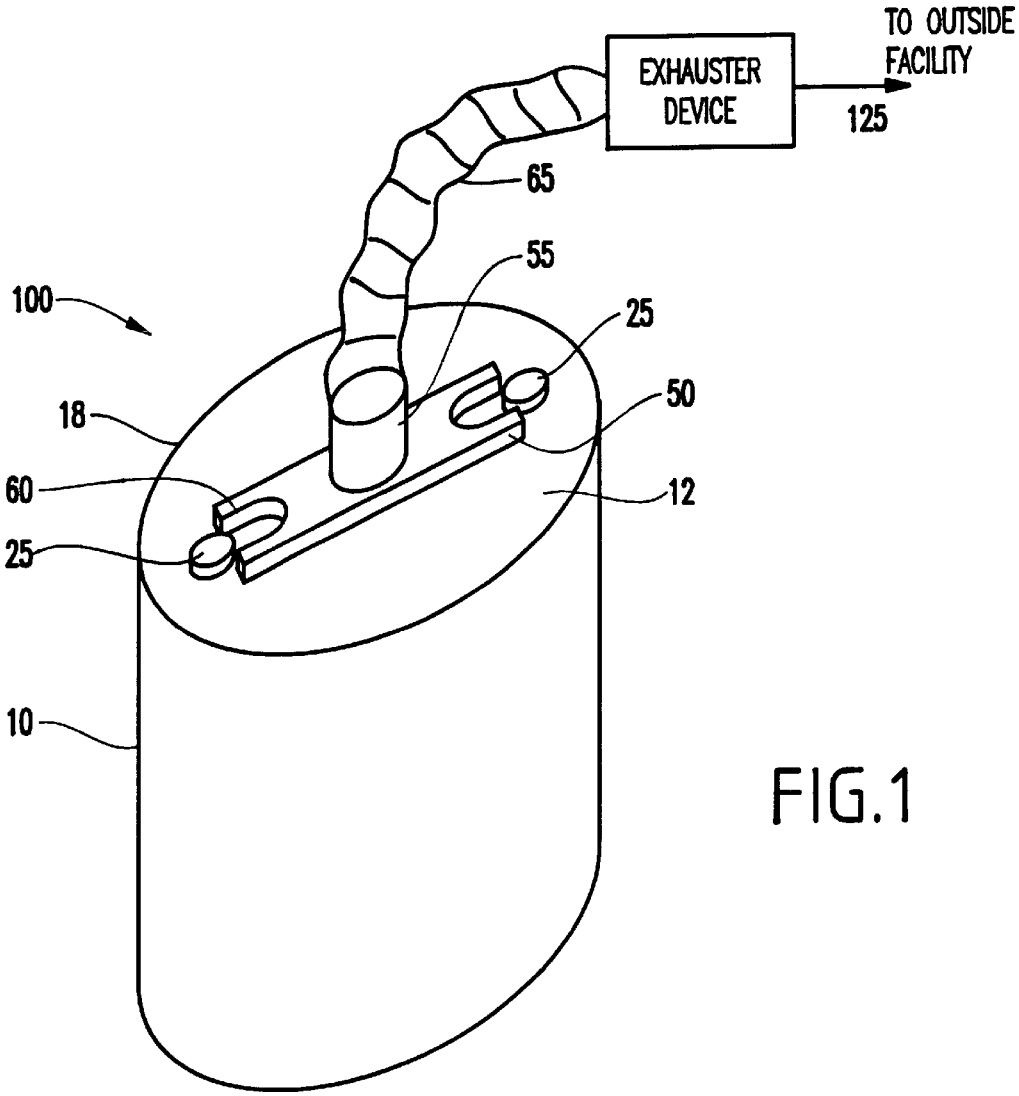
FIG. 1 is a perspective view of a barrel container using the venting lid cover of the present invention.

FIG. 1 shows a perspective view of an exemplary form of the venting lid cover 100 in accordance with the present invention when installed on a drum container 10. The invention is preferably used with drum container 10 that has a lid 16 having openings 25 (bung holes) that are usually two in number, but can be several. The bung holes are used for transferring fluids to and from the drum container. The drums are typically fifteen, thirty, and fifty-five gallon drums, and are used for storing and transporting materials, such as the hazardous materials discussed above. The drum container 10 is typically round, but can have different cross-sectional forms (e.g., rectangular, hexagonal etc.). The cover 100 can be used with non-transportable type containers. For example, the container could be collection container for waste materials that are collected during processing of a product where hazardous fumes have to be exhausted outside the facility for the safety of personnel.

Figure 2:
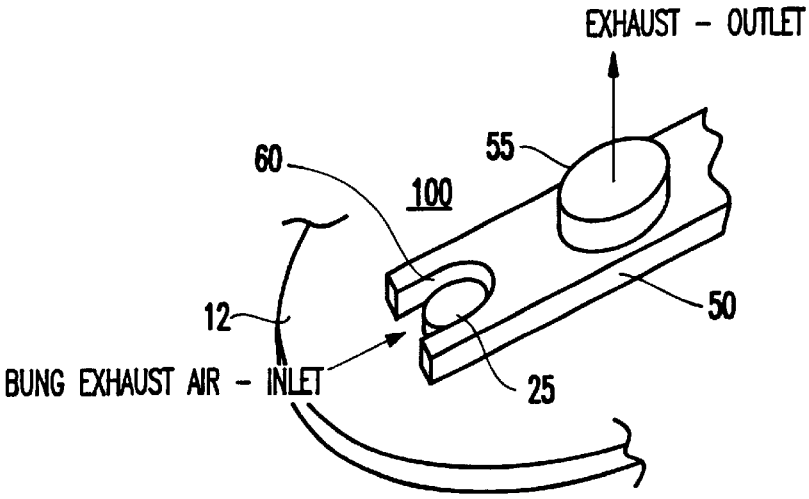
FIG. 2 is an enlarged partial perspective view of a venting lid cover.

A vapor plenum member 50 that has a single exhaust outlet 55 readily attaches to flexible ducting 65. The vapor plenum member 50 attaches to a plate member 12 which securely attaches to the lid 16. The plenum member 50 has vapor openings (e.g. inlets) 60 that are located next to bung holes 25 through the plate member 12. Vapors pass through the plenum member 50, then the exhaust outlet 55, and then through the ducting 65 to be exhausted by an exhauster device 125. The exhauster device 125 can be a fan, a exhaust pump or other vapor pumping device that creates a negative pressure at the vapor inlets 60 relative to the ambient surroundings. This ducting in turn can be attached to fixed ducting that exhausts outside the facility. Custom sized ducting with requisite sized adaptors provide the necessary flow rate for individual chemical & house exhaust connections as required. FIG. 2 shows the cover 100 in an enlarged perspective view showing one bung hole opening 25 relative to the vapor inlet port opening 60 in the plenum member 50.

Figure 3:
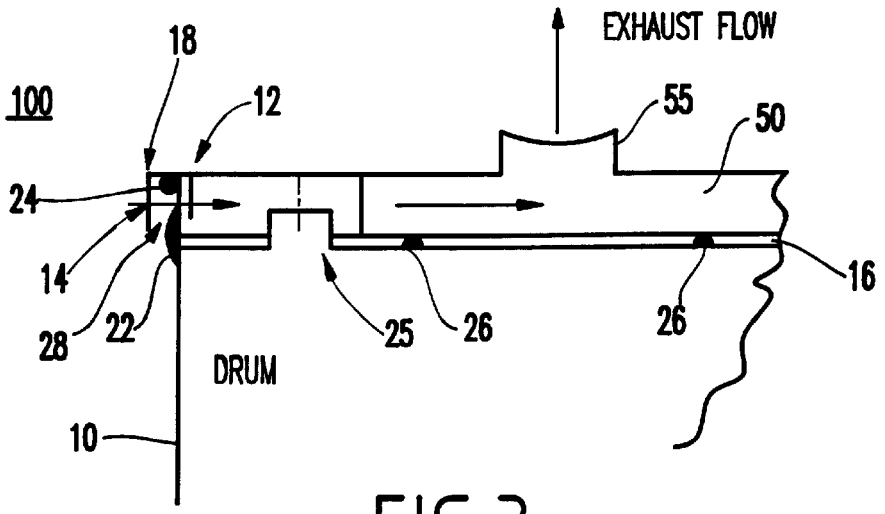
FIG. 3 is a partial cross-sectional view of the venting lid cover.
Figure 4:
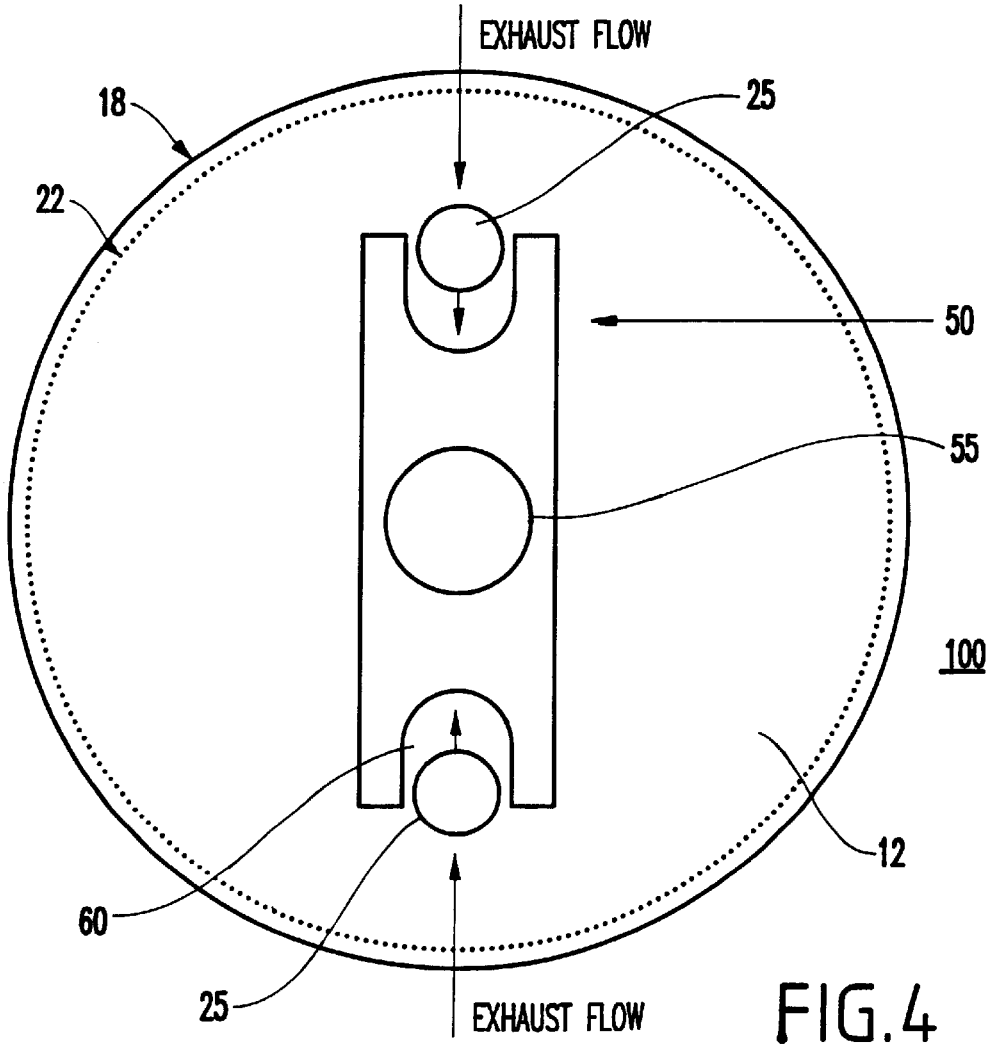
FIG. 4 is a top view of the venting lid cover in relation to container bung holes.

Referring now to FIGS. 3 and 4, a detailed cross-sectional view and top-view of the venting lid cover 100 is shown. The cover 100 includes a plate member 12 that is generally circular in shape having an upper surface with an outer rim 18 that is preferably formed integral with circular plate member 12.

The plate member 12 is above the plenum 50 in the embodiment shown in FIG. 3. However, the plate member 12 can be below the plenum and attached to the flat top side of the lid 16 as shown in FIGS. 1 and 2, depending on how the coaming 22 and bung hole 25 of the drum container is constructed. Thus, the plate can have the hollow plenum member 50 attached either on the top or bottom of the plate with the appropriate form as shown in FIGS. 1 and 2, so that the vapor inlet port 60 rises above the bung hole an ensures that vapors flow into the plenum when the exhauster device is operated.

The plate 12 preferably has a shape that conforms with the cross-sectional shape of the container. The outer rim 18 of the plate 12 has a recessed underside annular member 14 that conformably surrounds an entire exterior of the drum of the container coaming (drum lip) 22 that forms part of the drum container lid 16. The recessed underside member 14 conformably "snaps-on" the container coaming 22 when the cover 100 is attached to the container. The underside of the plate 12 can include rib members 26 that provide support and rigidity to the cover 100 when installed on the lid of a drum container.

Although the circular plate member 12 has an annular underside member 14 as shown, these and other elements may have other shapes such as an internal corrugation 28 to the sidewalls so as to create labyrinths for minimizing vapor escape. The venting lid cover 100 can also optionally include a sealing O-ring 24 mounted around a periphery of the plate member 12 in the recessed underside member 14 to seal the plate member 12 with the coaming 22 and prevent vapors from escaping. Also, such a feature can provide a positive snap fit when the cover is installed on the container. Typical materials used to construct the cover 100 are corrosive resistant materials such as stainless steel or durable plastics. The plenum member 50 is typically attached to the plate 12 using rivets, tapped screws, nuts and bolts or other well known fasteners when a built-up construction is used. Alternatively, by using an integral construction, the joints can be welded. If made of a durable plastic, the cover can be made from a one piece molded construction.

Other types of drum containers that the invention can be used with include blow-molded lidded barrel (wide-mouthed drum) having a barrel lid and tension-ring closure as similarly taught in U.S. Pat. No. 6,116,453, which is incorporated by reference.

The invention provides operators with a safety ventilation system that has a "snap-on" venting lid cover 100 that is easy to use with containers. The vapor inlet openings 60 of the invention that surround the bung openings 25 of the container automatically provide proper alignment when installed and an evacuating negative pressure seal when in use. Operators can easily attach the cover 100 to exhaust ducting of existing facility exhaust ducting or tool exhaust pod without major modification to existing equipment. Additionally, the invention allows for shut down of the exhauster device 125 once the bung hole connection(s) are made to a transfer device such as a pump out device as used in the manufacturing process. This minimizes need for continuous operation of the exhauster device 25, which can be of substantial expense (see remarks above in Background Section). Moreover, the invention most importantly minimizes or eliminates operator exposure to hazardous chemical vapors during drum hookup or sampling since the invention requires minimal training to operate and use. The invention also reduces operating costs by conveying vapors only from the bung holes 25 of the drum container which have much smaller exposure area, not a large enclosed area as used in open cabinet exhaust systems that require much greater air handling capacity.

Additionally, when using the invention, less exhaust is generated by a facility that in turn produce fewer emissions to the environment (an environmental regulatory concern). Less exhaust vapors also maintains the chemical assay of agents in the transported containers, especially when these agents are highly volatile chemicals.

While the invention has been described in terms of preferred embodiments, those skilled in the art will recognize that the invention can be practiced with modification within the spirit and scope of the appended claims.

What is claimed is:

1. A venting lid cover for a container, said cover comprising:

a plate member having a shaped edge that configurably seals with a coaming of said container when installed; and a plenum member attached to said plate member, wherein said plate member has an opening for passage of a container bung hole, and said plenum member has a vapor inlet port juxtaposed to said plate opening.

2. The venting lid cover of claim 1, further comprising a sealing O-ring mounted in an annular section of said plate member to provide enhanced sealing of said plate member when said plate member is configurably mated with said coaming.

3. The venting lid cover of claim 1, wherein said plate member has an outer rim having a recessed underside annular section that configurably provides a "snap-on" connection with said coaming.

4. The venting lid cover of claim 3, wherein said annular section has corrugated sides forming a labyrinth seal.

5. The venting lid cover of claim 1, wherein said plenum member includes an exhaust outliet duct that configurably attaches to a ducting member for conveying exhaust vapors by an exhauster device.

6. The venting lid cover of claim 1, wherein said vapor inlet port of said plenum member has a cross-sectional opening that rises above and substantially encompasses said bung hole.

7. The venting lid cover of claim 1, further comprising an exhaust duct attached to said plenum member.

8. A venting lid cover for a container, said venting lid cover having a conformable shape to fit a container lid, said cover comprising:

a plenum member; and at least one vent opening that cooperatively allows passage of an equal number of holes in said container lid, wherein said plenum member has a vapor inlet port juxtaposed to, and not obstructing, each vent opening.

9. The venting lid cover of claim 8, further comprising a sealing ring mounted around a periphery of said venting lid cover to provide an enhanced seal.

10. The venting lid cover of claim 8, wherein said plate member has an outer rim having a recessed underside annular section that configurably provides a "snap-on" connection.

11. The venting lid cover of claim 10, wherein said annular section has corrugated sides forming a labyrinth seal.

12. The venting lid cover of claim 8, wherein said plenum member includes an exhaust outlet duct that configurably attaches to a ducting member for conveying exhaust vapors by an exhauster device.

13. The venting lid cover of claim 8, wherein said vapor Inlet port of said plenum member has a cross-sectional opening that rises above and substantially encompasses said vent opening.

14. The venting lid cover of claim 8, further comprising an exhaust duct attached to said plenum member.

15. A venting device for a container having at least one opening, said venting device comprising;

a plate member with an attached vapor inlet port positioned adjacent to, and not obstructing, said opening; and an exhauster device attached to said vapor inlet port.

16. The venting device in claim 15, wherein said inlet port partially surrounds said opening.

17. The venting device in claim 15, further comprising a sealing ring mounted around a periphery of said venting device to provide an enhanced seal.

18. The venting device of claim 15, wherein said plate member has an outer rim having a recessed underside annular section that configurably provides a "snap-on" sealing connection with said container.

19. The venting device of claim 15, wherein said vapor inlet port of said plenum member has a cross-sectional opening that rises above and substantially encompasses said opening.

20. The venting device of claim 15, wherein said exhauster device comprises ducting and a vapor pumping device.

* * * * *